US011636990B1

(12) United States Patent
Hsieh et al.

(10) Patent No.: US 11,636,990 B1
(45) Date of Patent: Apr. 25, 2023

(54) KEY STRUCTURE

(71) Applicant: Chicony Electronics Co., Ltd., New Taipei (TW)

(72) Inventors: Chao-Chin Hsieh, New Taipei (TW); Chun-Chieh Chan, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/573,638

(22) Filed: Jan. 12, 2022

(30) Foreign Application Priority Data

Oct. 25, 2021 (TW) ..... 110139453

(51) Int. Cl.
*H01H 13/14* (2006.01)

(52) U.S. Cl.
CPC ..... *H01H 13/14* (2013.01); *H01H 2233/07* (2013.01)

(58) Field of Classification Search
CPC ..... H01H 13/14; H01H 2233/07; H01H 3/12; H01H 13/70; H01H 13/705; H01H 13/7065; H01H 2209/026; H01H 2209/03; H01H 2215/004; H01H 2215/008; H01H 2227/022
See application file for complete search history.

(56) References Cited

U.S. PATENT DOCUMENTS 8,222,545 B2 * 7/2012 Tsai ..... G06F 3/0202 200/5 A

* cited by examiner

*Primary Examiner* — Lheiren Mae A Caroc
(74) *Attorney, Agent, or Firm* — JCIPRNET

(57) ABSTRACT

A key structure includes a bottom plate, at least one keycap, and a thin-film circuit board. The bottom plate has at least one elastic protruding portion. The keycap is liftably connected to the bottom plate and has a press portion and at least one trigger portion. The press portion is located at a central region of the keycap and faces the elastic protruding portion, and the trigger portion is located at a peripheral region of the keycap. When the key is lowered from a first position to a second position relatively to the bottom plate, the press portion downwardly presses the elastic protruding portion, and the press portion triggers an electrical trigger point of the thin-film circuit board. The keycap is adapted to be restored from the second position to the first position through an elastic force of the elastic protruding portion.

12 Claims, 11 Drawing Sheets

KEY STRUCTURE

CROSS-REFERENCE TO RELATED APPLICATION

This application claims the priority benefit of Taiwan application serial no. 110139453, filed on Oct. 25, 2021. The entirety of the above-mentioned patent application is hereby incorporated by reference herein and made a part of this specification.

BACKGROUND

Technology Field

The disclosure relates to an input structure, and particularly, to a key structure.

Description of Related Art

The design of personal electronic products such as laptop computers is becoming thinner and lighter, allowing consumers to easily carry and use these electronic products. In the keyboard module of a laptop computer, most key structures include a scissor mechanism for keycaps to be lifted and lowered. However, the configuration of the scissor mechanism increases the thickness of the keyboard module, which goes against the thin design trend of laptop computers.

SUMMARY

The disclosure provides a key structure with a small thickness.

The key structure of the disclosure includes a bottom plate, at least one keycap, and a thin-film circuit board. The bottom plate has at least one elastic protruding portion. The keycap is liftably connected to the bottom plate and has a press portion and at least one trigger portion. The press portion is located in a central region of the keycap and faces the elastic protruding portion, and the trigger portion is located in a peripheral region of the keycap. When the keycap is lowered from a first position to a second position relative to the bottom plate, the press portion downwardly presses the elastic protruding portion. The keycap is adapted to restore from the second position to the first position through an elastic force of the elastic protruding portion. The thin-film circuit board is disposed on the bottom plate and located between the bottom plate and the keycap. The thin-film circuit board has at least one electrical trigger point, and the trigger portion faces the electrical trigger point. When the keycap is located at the second position, the trigger portion triggers the electrical trigger point.

In an embodiment of the disclosure, the bottom plate has multiple holes, and a portion of the bottom plate among the holes constitutes the elastic protruding portion.

In an embodiment of the disclosure, the elastic protruding portion has a protruding point, and the protruding point is in contact with the press portion.

In an embodiment of the disclosure, the bottom plate has at least one first sliding portion, the keycap has at least one second sliding portion, and the first sliding portion and the second sliding portion are slidably disposed on each other. When the keycap is lifted and lowered relative to the bottom plate, the first sliding portion and the second sliding portion slide relatively.

In an embodiment of the disclosure, the second sliding portion has a sliding groove, and an end of the first sliding portion is confined in the sliding groove. When the keycap is lifted and lowered relative to the bottom plate, the end slides in the sliding groove.

In an embodiment of the disclosure, the sliding groove has an opening facing the bottom plate, and an outer diameter of the end is greater than an inner diameter of the opening.

In an embodiment of the disclosure, the first sliding portion has a slot, the second sliding portion has a hook, and the hook is clamped in the slot. When the keycap is lifted and lowered relative to the bottom plate, the hook moves in the slot.

In an embodiment of the disclosure, the first sliding portion is formed by bending part of a structure of the bottom plate.

In an embodiment of the disclosure, the thin-film circuit board has an opening, and the first sliding portion passes through the opening and extends toward the keycap.

In an embodiment of the disclosure, the thin-film circuit board has an opening, and the elastic protruding portion passes through the opening and protrudes toward the keycap.

In an embodiment of the disclosure, the keycap has an annular flange extending along a periphery of the keycap, and the trigger portion is at least one convex point formed on the annular flange.

In an embodiment of the disclosure, the number of the trigger portion is plural, and the trigger portions are located at multiple corners of the keycap, respectively.

In summary, in the key structure of the disclosure, the bottom plate itself has elastic protruding portions corresponding to the keycaps. The elastic protruding portions may provide the user with a feel when pressing a keycap through the elastic force and elastic deformation ability, and the keycap may be restored in an upward manner through a top support of the elastic protruding portion after being pressed down. Accordingly, unlike the conventional design which requires the configuration of a scissor mechanism under the keycap, the disclosure may effectively reduce the overall thickness of the key structure.

DESCRIPTION OF THE EMBODIMENTS

Figure 1:
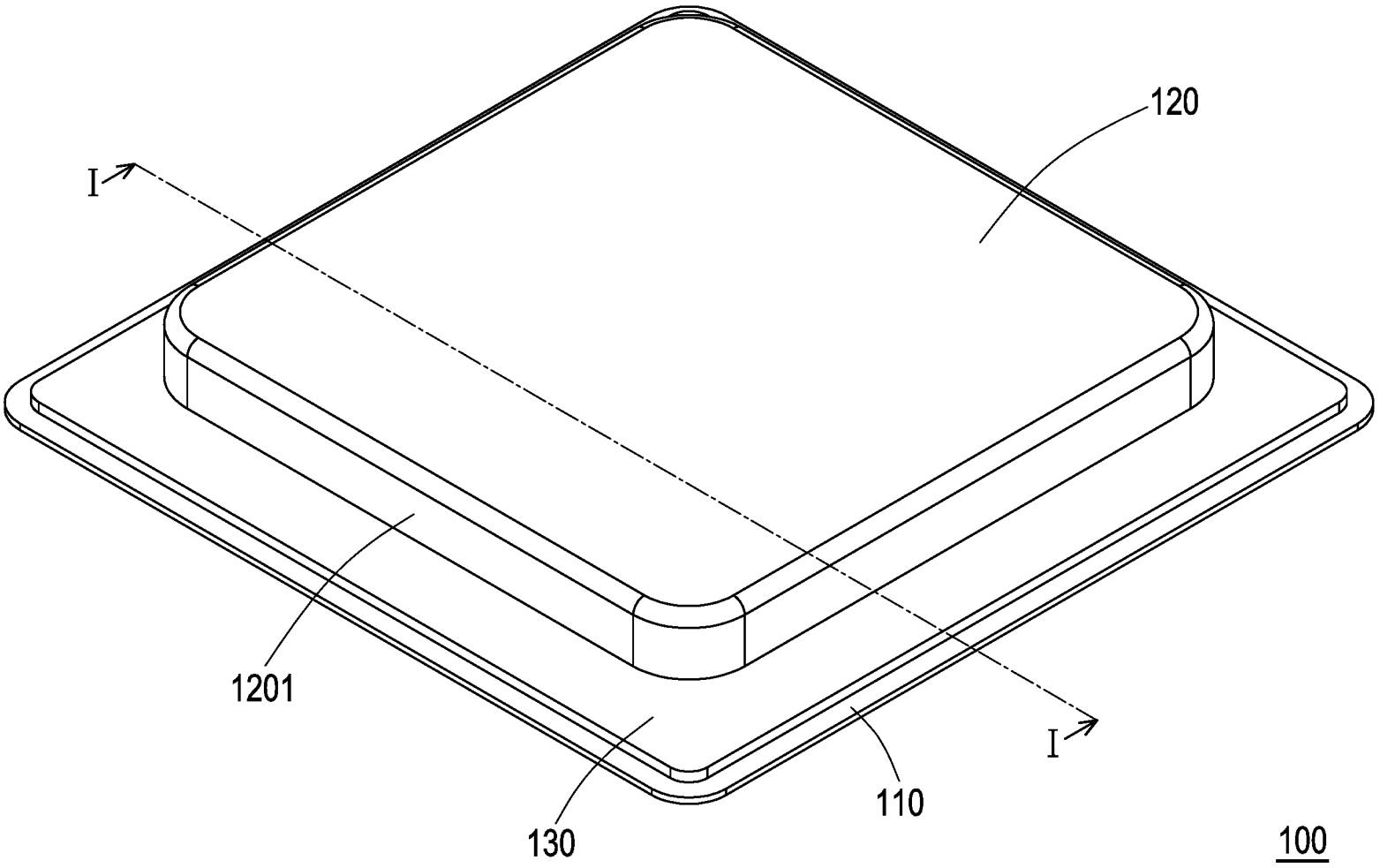
FIG. 1 is a perspective view of a key structure according to an embodiment of the disclosure.
Figure 2:
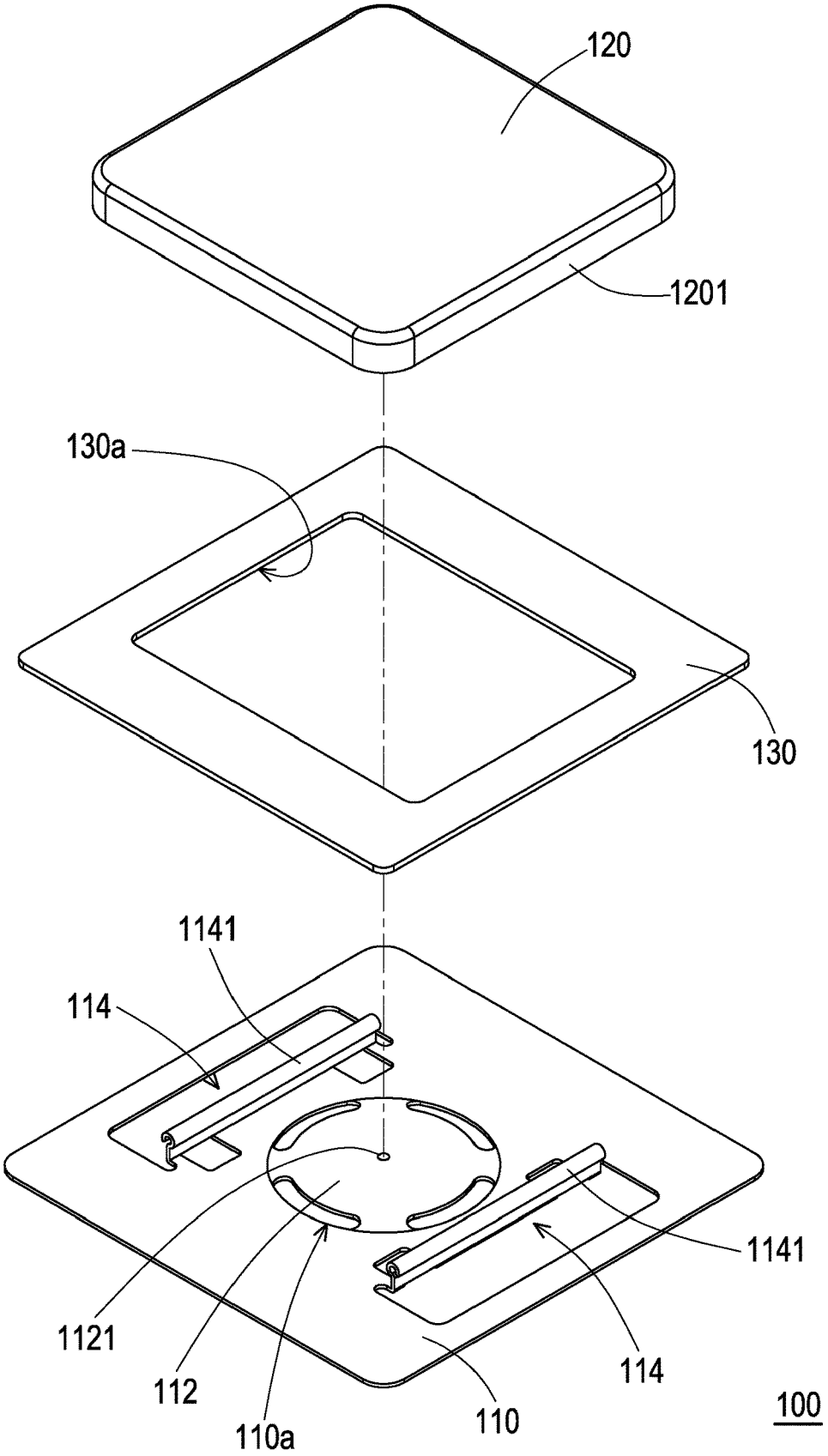
FIG. 2 is an exploded view of the key structure of FIG. 1.
Figure 3:
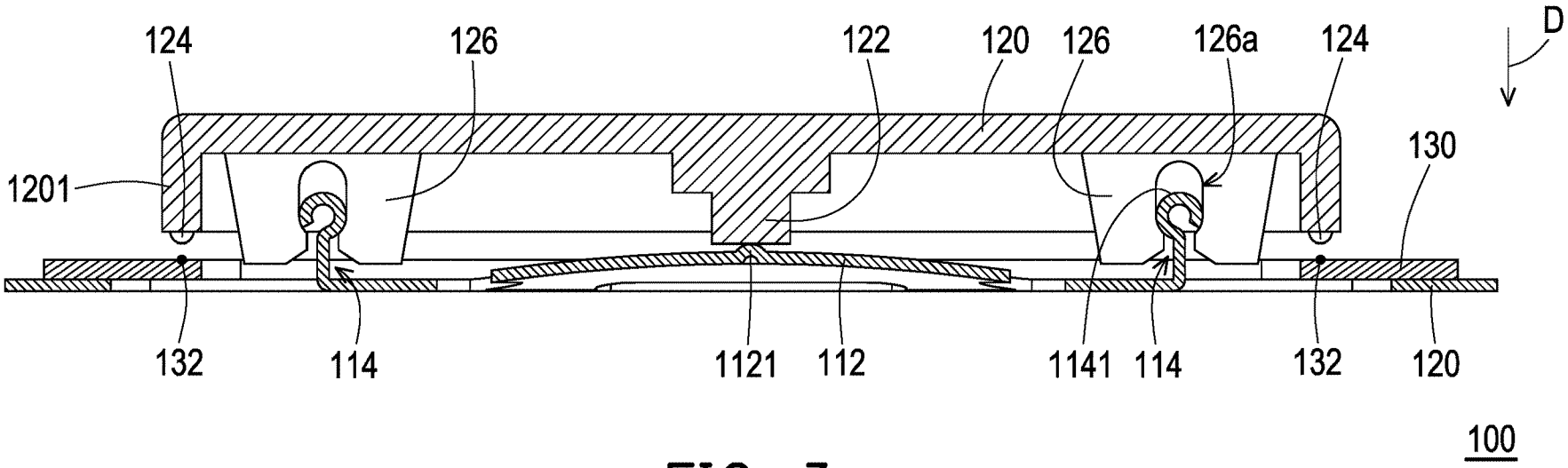
FIG. 3 is a cross-sectional view of the key structure of FIG. 1.

FIG. 1 is a perspective view of a key structure according to an embodiment of the disclosure. FIG. 2 is an exploded view of the key structure of FIG. 1. FIG. 3 is a cross-sectional view of the key structure of FIG. 1, which corresponds to the I-I line of FIG. 1. Referring to FIG. 1 to FIG. 3, a key structure 100 of the embodiment includes a bottom plate 110, at least one keycap 120 (one keycap is shown), and a thin-film circuit board 130. The bottom plate 110 has at least one elastic protruding portion 112 (one elastic protruding portion is shown). The keycap 120 is liftably connected to the bottom plate 110 along a direction D (as shown in FIG. 3) perpendicular to the bottom plate 110 and has a press portion 122 and at least one trigger portion 124 (multiple triggers are shown). The press portion 122 is located in the central region of the keycap 120 and faces the elastic protruding portion 112, and the trigger portion 124 is located in the peripheral region of the keycap 120.

The thin-film circuit board 130 is disposed on the bottom plate 110 and located between the bottom plate 110 and the keycap 120. The thin-film circuit board 130 has an opening 130*a*, and the elastic protruding portion 112 of the bottom plate 110 passes through the opening 130*a* of the thin-film circuit board 130 and protrudes toward the keycap 120. The thin-film circuit board 130 has at least one electrical trigger point 132, and the trigger portion 124 of the keycap 120 faces the electrical trigger point 132 of the thin-film circuit board 130. In FIG. 3, the electrical trigger point 132 is shown schematically, and the electrical trigger point 132 may actually include electrical pads formed on the surface and/or the inner layer of the thin-film circuit board 130. In other embodiments, the quantity of keycaps 120 may be plural, and the quantity of elastic protruding portions 112 is correspondingly plural. The area of the bottom plate 110 and the area of the thin-film circuit board 130 are correspondingly enlarged, which is not limited by the disclosure.

Figure 4:
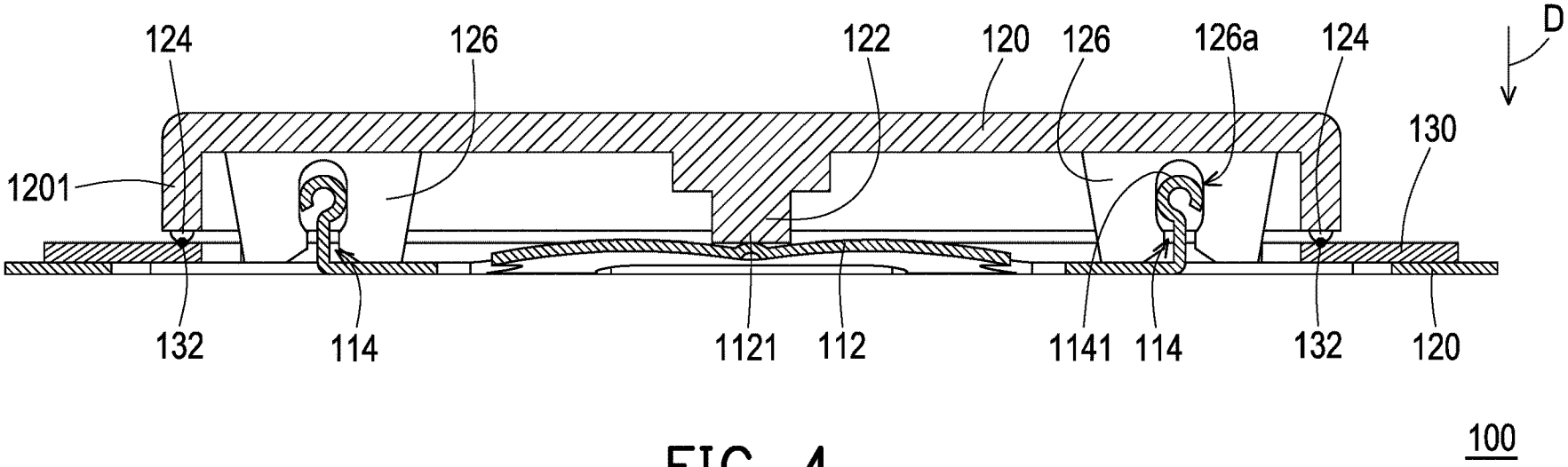
FIG. 4 illustrates that the keycap of FIG. 3 is pressed.

FIG. 4 illustrates that the keycap of FIG. 3 is pressed. When a user presses the keycap 120 to be lowered from the first position shown in FIG. 1 to the second position shown in FIG. 2 relative to the bottom plate 110, the press portion 122 of the keycap 120 downwardly presses the elastic protruding portion 112 of the bottom plate 110, and the trigger portion 124 of the keycap 120 triggers the electrical trigger point 132 of the thin-film circuit board 130. When the user no longer presses the keycap 120, the keycap 120 is restored from the second position shown in FIG. 4 to the first position shown in FIG. 1 through an elastic force of the elastic protruding portion 112.

With the configuration, the elastic protruding portion 112 of the bottom plate 110 may provide the user with a feel when pressing the keycap 120 through the elastic force and elastic deformation ability, and the keycap 120 may be restored in an upward manner through a top support of the elastic protruding portion 112 after being pressed down. Accordingly, unlike the conventional design which requires the configuration of other connectors such as a scissor mechanism under the keycap 120, the disclosure may effectively reduce the overall thickness of the key structure 100. Since the elastic protruding portion 112 is formed under the central region of the keycap 120, the trigger position (i.e., the electrical trigger point 132) of signals is not disposed under the central region of the keycap 120 but disposed under the peripheral region of the keycap 120, and the elastic protruding portion 112 is prevented from being overlapped with the trigger position of signals, which contributes to eliminating the configuration difficulty.

In the embodiment, for example, the bottom plate 110 is a metal plate body and has multiple holes 110*a*, and the portion of the bottom plate 110 among the holes 110*a* constitutes the elastic protruding portion 112. With the formation of the holes 110*a*, the elastic protruding portion 112 may have sufficient elastic deformation ability. Moreover, the elastic protruding portion 112 of the embodiment has a protruding point 1121, and the protruding point 1121 is used to be in contact with the press portion 122 of the keycap 120, so that the contact force between the elastic protruding portion 112 and the press portion 122 is concentrated.

The connection relationship between the keycap and the bottom plate of the embodiment is illustrated in detail in the subsequent paragraphs. Referring to FIG. 2 and FIG. 3, the bottom plate 110 of the embodiment has at least one first sliding portion 114 (multiple first sliding portions are shown), and the keycap 120 has at least one second sliding portion 126 (multiple second sliding portions are shown). The first sliding portion 114 passes through the opening 130*a* of the thin-film circuit board 130 and extends toward the keycap 120. The structures of the first sliding portion 114 and the second sliding portion 126 may be matched to each other for clamping and sliding. When the keycap 120 is lifted and lowered relative to the bottom plate 110, the first sliding portion 114 and the second sliding portion 126 relatively slide up and down. In the embodiment, the first sliding portion 114 is formed by bending part of the structure of the bottom plate 110 upward, for example, and the second sliding portion 126 is formed integrally with the keycap 120 by injection molding or the like, for example.

In the embodiment, for example, the bottom plate 110, the elastic protruding portion 112 thereof, and the first sliding portion 114 are formed into an integral structure by stamping a metal plate base material. The elastic protruding portion 112 is stamped into a collapsible dome form and supported by the material of the bottom plate 110 around the elastic protruding portion 112. When the elastic protruding portion 112 is pressed down under an external force, the elastic protruding portion 112 collapses downward relative to the surrounding bottom plate 110 as shown in FIG. 3 to FIG. 4, and when the external force is no longer applied to the elastic protruding portion 112, the elastic protruding portion 112 rebounds upward and restores the position as shown in FIG. 4 to FIG. 3. Moreover, the first sliding portion 114 is stamped into the form of a folded upward wall, and an end 1141 of the first sliding portion 114 is rolled downwards to have a larger outer diameter for matching with the second sliding portion 126.

Figure 5:
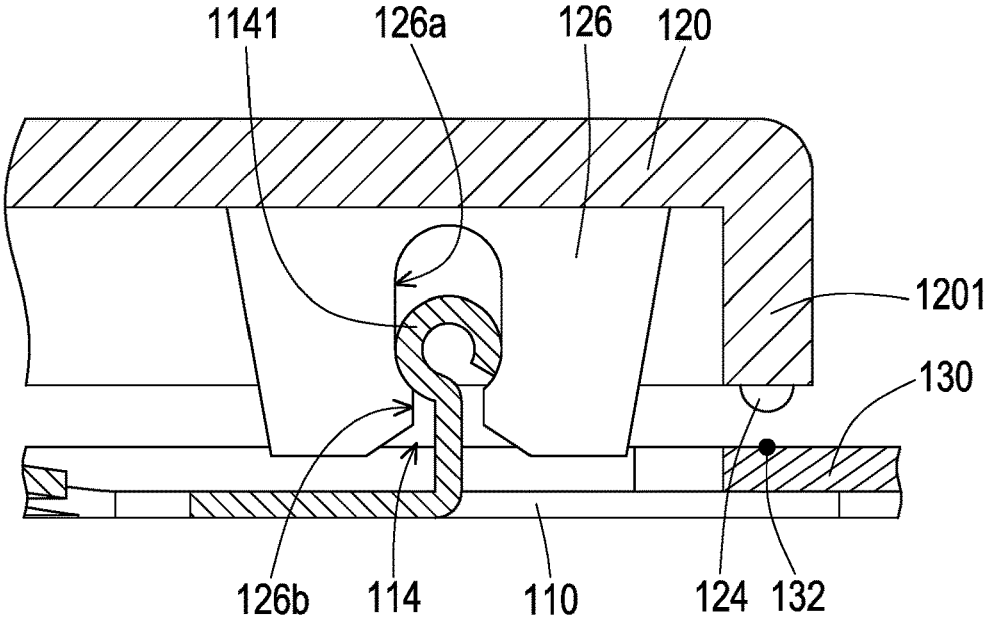
FIG. 5 illustrates part of the enlarged key structure of FIG. 3.
Figure 6:
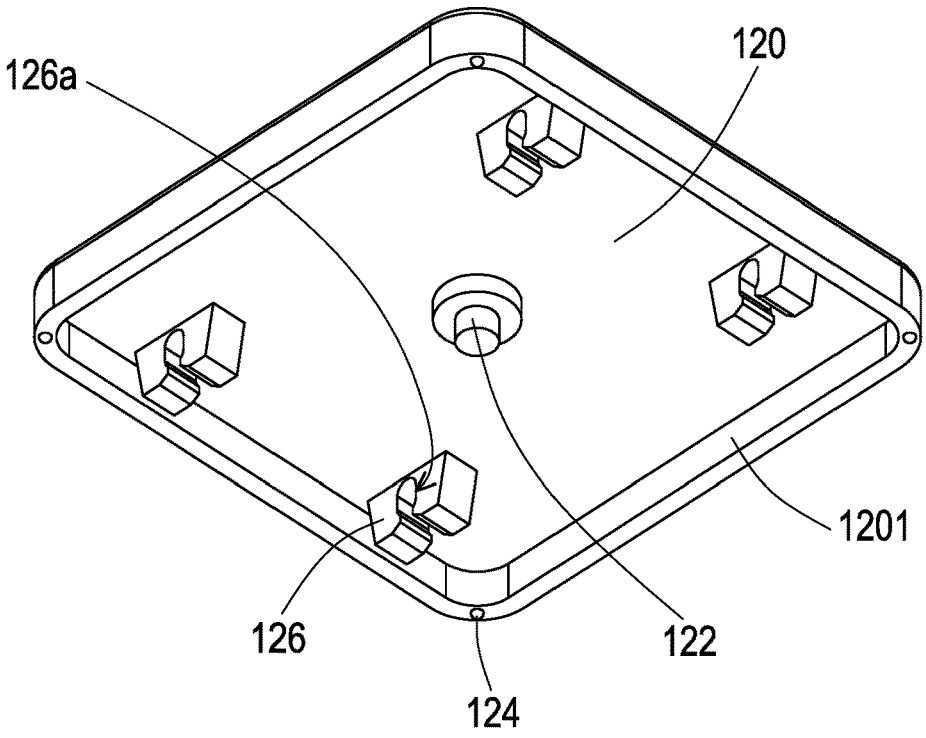
FIG. 6 is a perspective view of the keycap of FIG. 1.

FIG. 5 illustrates part of the enlarged key structure of FIG. 3. FIG. 6 is a perspective view of the keycap of FIG. 1. Referring to FIG. 5 and FIG. 6, specifically, the second sliding portion 126 of the embodiment is manufactured together with the main body of the keycap 120, for example, by an injection molding process. The second sliding portion 126 protrudes from the bottom surface of the main body of the keycap 120 and has a sliding groove 126*a*, and for example, the sliding groove 126*a* is waterdrop shaped and has an opening 126*b* (as shown in FIG. 5) facing the bottom plate 110. The end 1141 of the first sliding portion 114 is located in the sliding groove 126*a*, and the outer diameter of the end 1141 is greater than the inner diameter of the opening 126*b*, so that the end 1141 of the first sliding portion 114 is confined in the sliding groove 126*a*. When the keycap 120 is lifted and lowered relative to the bottom plate 110, the end 1141 of the first sliding portion 114 slides in the sliding groove 126*a*.

In the embodiment, the number of the first sliding portions 114 is two as shown in FIG. 2, the number of the second sliding portions 126 is four as shown in FIG. 6, and every two second sliding portions 126 correspond to the first sliding portion 114. In other embodiments, the first sliding portion 114 and the second sliding portion 126 may have other suitable numbers and corresponding relationships, which are not limited in the disclosure.

The keycap 120 of the embodiment has an annular flange 1201, and the annular flange 1201 extends along the periphery of the keycap 120. The trigger portion 124 is a convex point formed on the annular flange 1201 and is located at multiple corners of the keycap 120, respectively. Thereby, even if the user presses the keycap 120 with an uneven pressing force, as long as any convex point (the trigger portion 124) can be in contact with the corresponding electrical trigger point 132, the trigger effect can be smoothly achieved. In the embodiment, the electrical trigger points 132 in the thin-film circuit board 130 are electrically connected to each other, for example. In other embodiments, the number and positions of the trigger portions may be changed according to design requirements, and the disclosure is not limited thereto.

Figure 7:
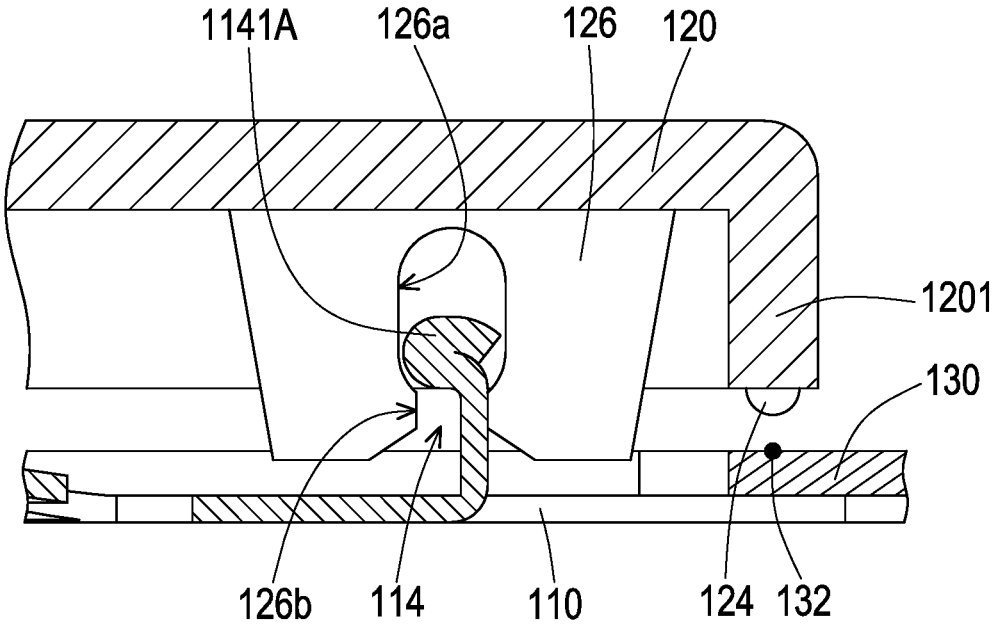
FIG. 7 and FIG. 8 illustrate part of enlarged key structures according to other embodiments of the disclosure.
Figure 8:
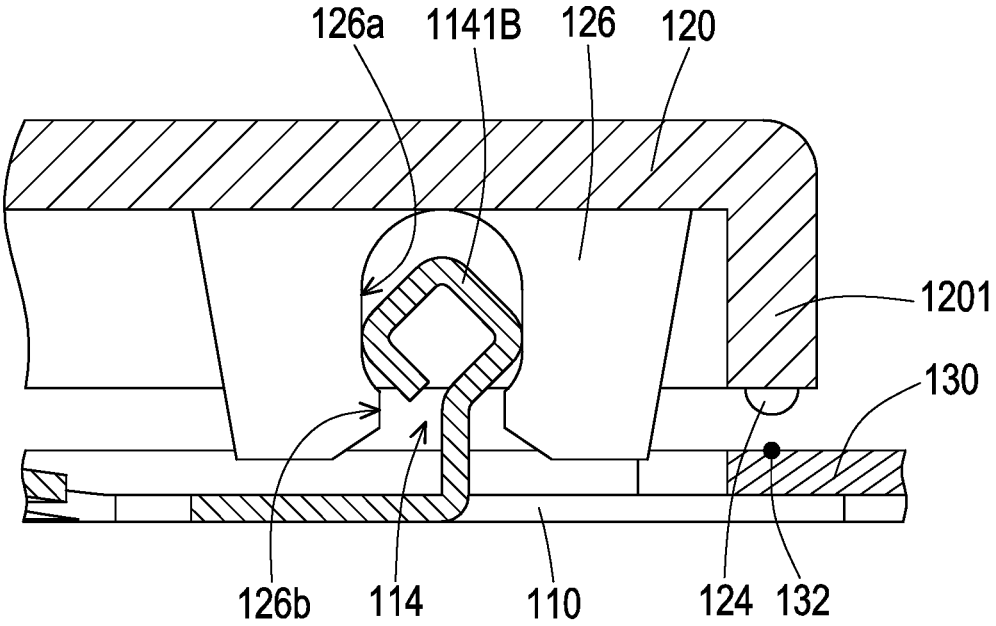

FIG. 7 and FIG. 8 illustrate part of enlarged key structures according to other embodiments of the disclosure. The difference between the embodiment shown in FIG. 7 and FIG. 8 and the embodiment shown in FIG. 5 is that the cross-sectional profile of the end 1141 of the first sliding portion 114 of FIG. 5 is arc-shaped and includes a structure similar to a shaft, the cross-sectional profile of an end 1141A of the first sliding portion 114 in FIG. 7 is relatively flat, and the cross-sectional profile of an end 1141B of the first sliding portion 114 in FIG. 8 is approximately square. In other embodiments, the end 1141 of the first sliding portion 114 may have a cross-sectional profile of other shapes as long as the ends 1141A and 1141B of the first sliding portion 114 are located in the sliding groove 126*a* and the outer diameters of the ends 1141A and 1141B are greater than the inner diameter of the opening 126*b*, and the ends 1141A and 1141B of the first sliding portion 114 are confined in the sliding groove 126*a*, which is not limited in the disclosure.

Figure 9:
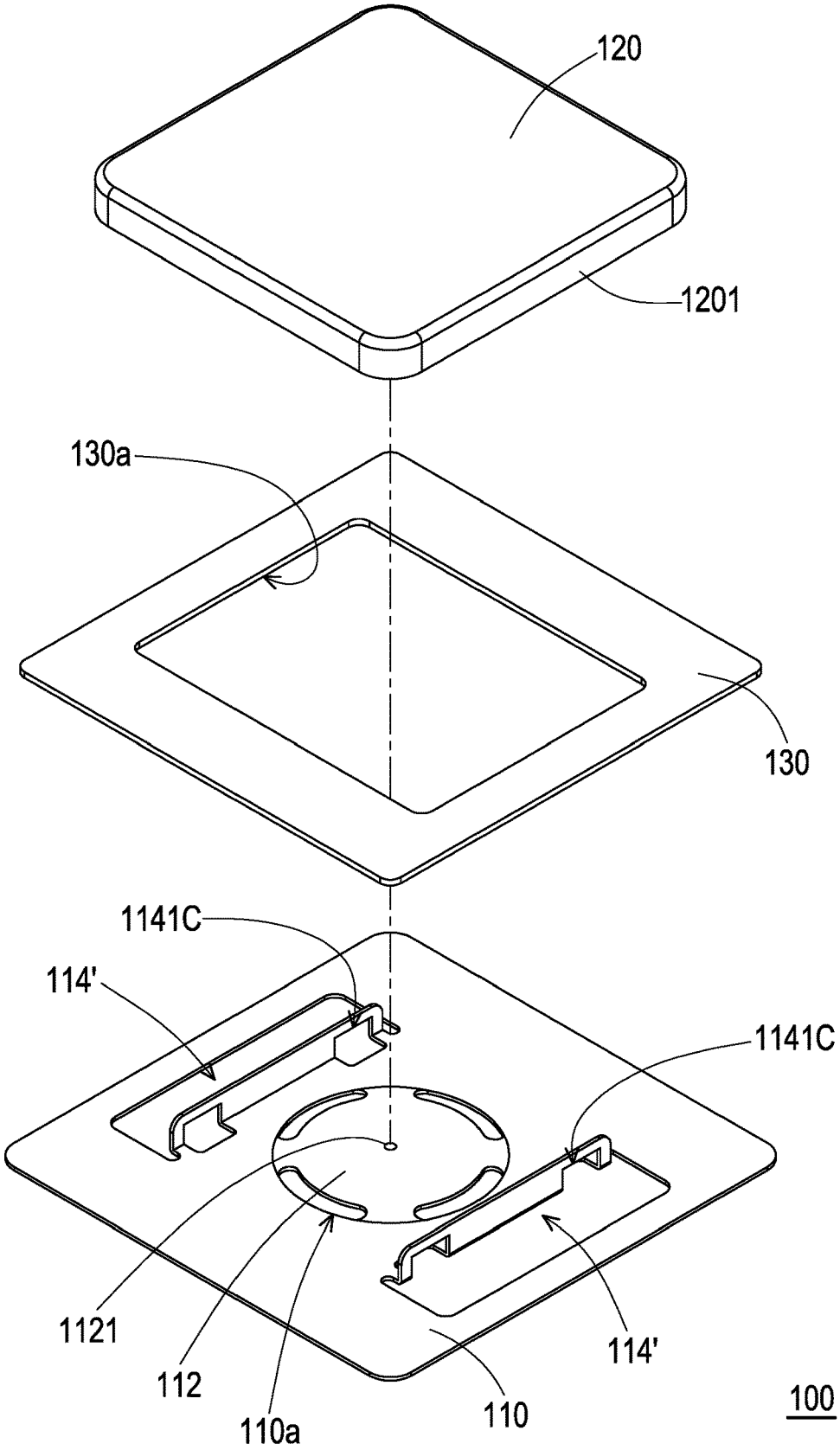
FIG. 9 is an exploded view of a key structure according to another embodiment of the disclosure.
Figure 10:
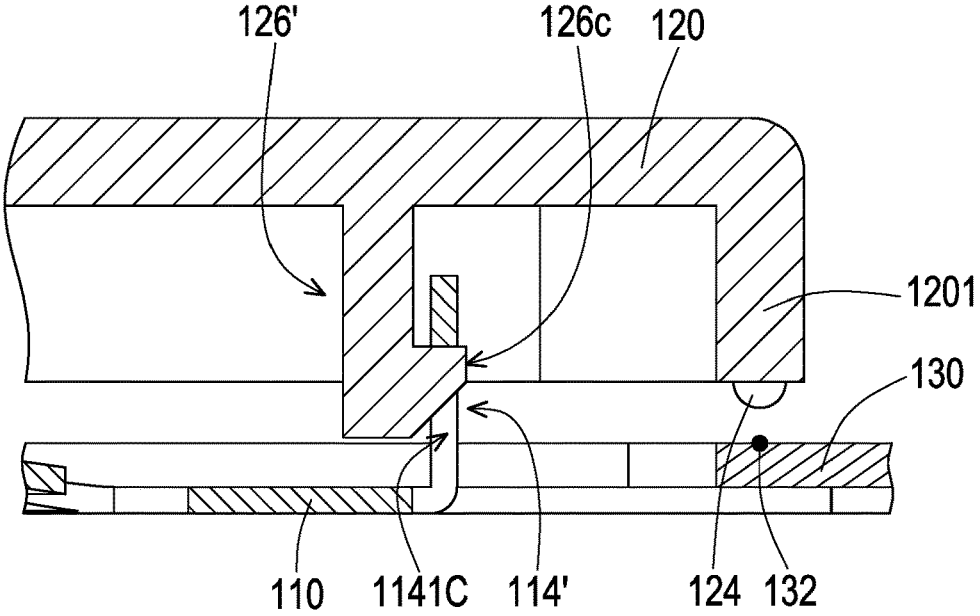
FIG. 10 illustrates part of the enlarged key structure of FIG. 9.
Figure 11:
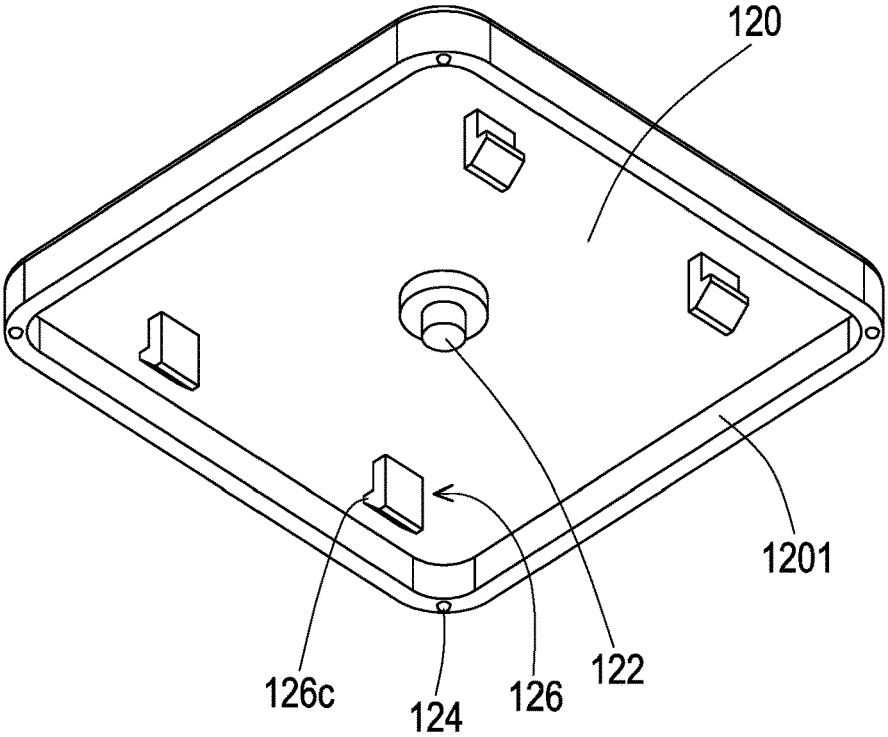
FIG. 11 is a perspective view of the keycap of FIG. 9.

FIG. 9 is an exploded view of a key structure according to another embodiment of the disclosure. FIG. 10 illustrates part of the enlarged key structure of FIG. 9. FIG. 11 is a perspective view of the keycap of FIG. 9. The difference between the embodiment shown in FIG. 9 to FIG. 11 and the foregoing embodiment is that in the embodiment shown in FIG. 9 to FIG. 11, a first sliding portion 114' has a slot 1141C, a second sliding portion 126' has a hook 126*c*, and the hook 126*c* is clamped in the slot 1141C. When the keycap 120 is lifted and lowered relative to the bottom plate 110, the hook 126*c* moves in the slot 1141C. In other embodiments, the first sliding portion and the second sliding portion may be other forms of mutually sliding structures, which is not limited by the disclosure.

Figure 12:
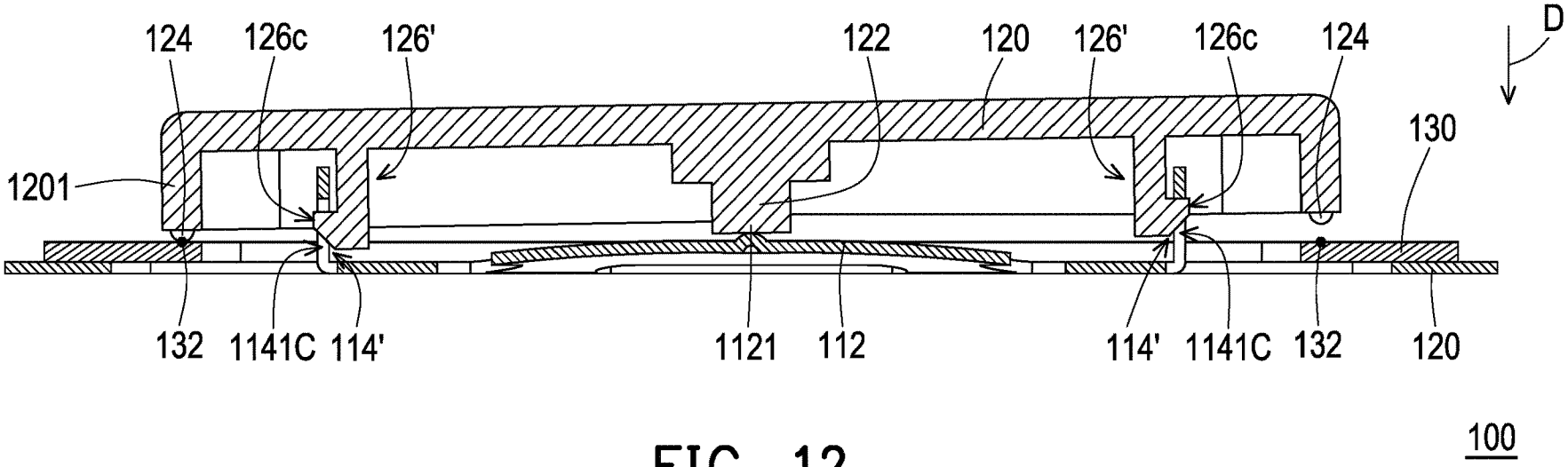
FIG. 12 illustrates the keycap of FIG. 10 tilted.
Figure 13:
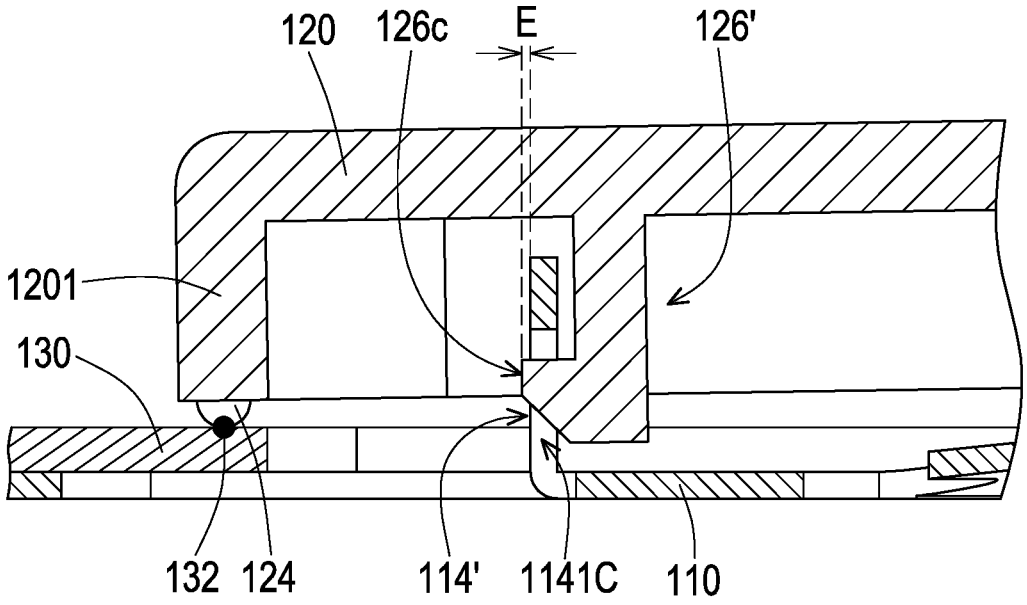
FIG. 13 illustrates part of the enlarged key structure of FIG. 12.

FIG. 12 illustrates the keycap of FIG. 10 tilted. FIG. 13 illustrates part of the enlarged key structure of FIG. 12. In the embodiment, when the keycap 120 is pressed down, the hook 126*c* may move downward accordingly. If the user presses an edge or a corner of the keycap 120 to tilt the keycap 120 as shown in FIG. 12, the hook 126*c* may be inclined accordingly as shown in FIG. 13. To prevent the hook 126*c* from detaching from the slot 1141C of the first sliding portion 114' in the inclined state as shown in FIG. 13, the hook 126*c* is required to have a sufficient extension length so that the slot 1141C of the first sliding portion 114' and the hook 126*c* has a sufficient fitting amount E. With the sufficient fitting amount E, the hook 126*c* may not detach from the first sliding portion 114' of the bottom plate 110 when the hook 126*c* is at its maximum inclination angle.

Figure 14:
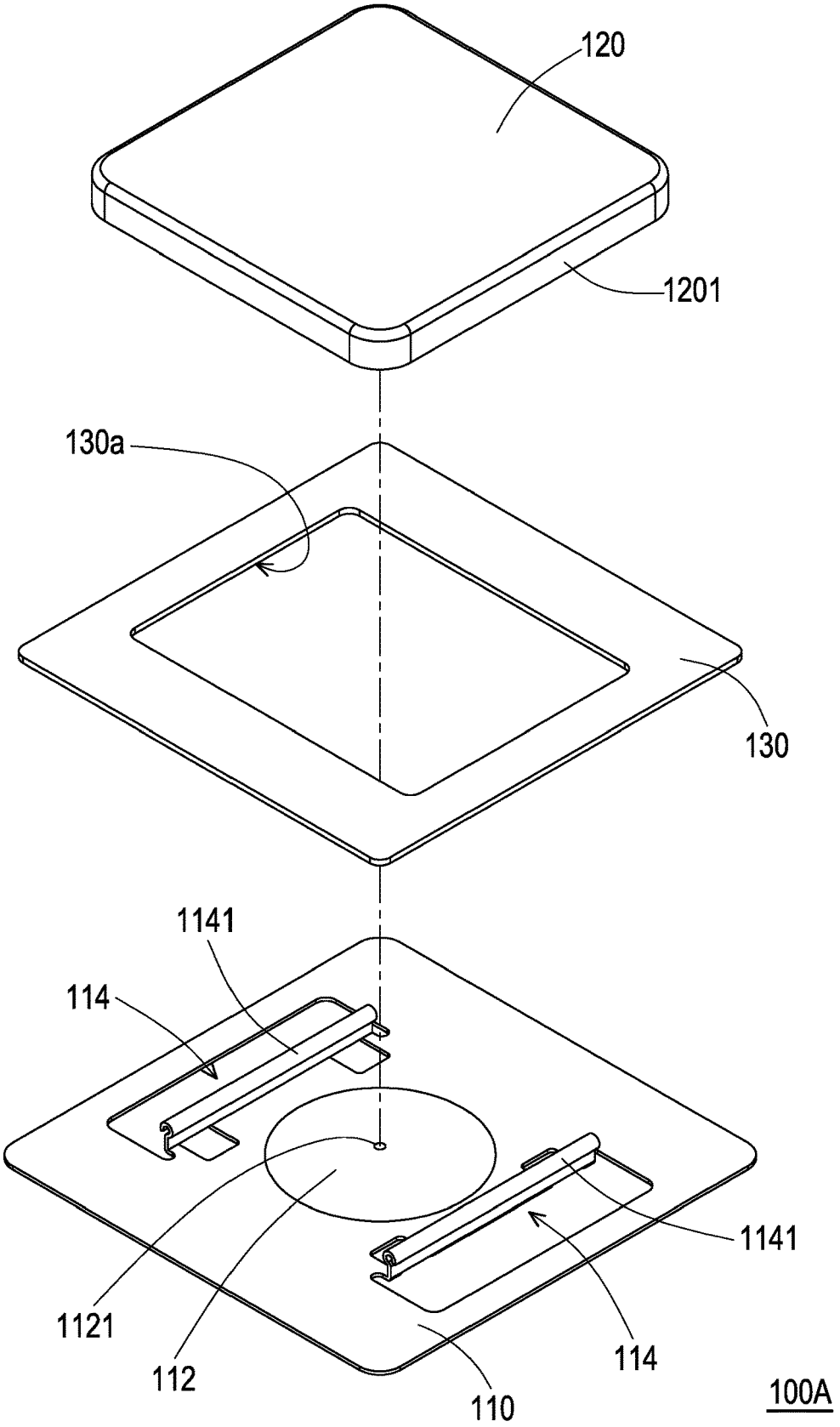
FIG. 14 is an exploded view of a key structure according to another embodiment of the disclosure.

FIG. 14 is an exploded view of a key structure according to another embodiment of the disclosure. The difference between the embodiment shown in FIG. 14 and the embodiment shown in FIG. 2 is that in a key structure 100A of FIG. 14, there is no hole 110*a* as shown in FIG. 2 on the bottom plate 110 around the elastic protruding portion 112. In this design method, when the elastic protruding portion 112 is pressed down under an external force, the elastic protruding portion 112 can still have a certain degree of elastic deformation ability and collapse downward relative to the material of the surrounding bottom plate 110, and when the external force is no longer applied to the elastic protruding portion 112, the elastic protruding portion 112 can rebound upward and restore the position through elastic deformation ability.

In summary, in the key structure of the disclosure, the bottom plate itself has elastic protruding portions corresponding to the keycaps. The elastic protruding portions may provide the user with a feel when pressing a keycap through the elastic force and elastic deformation ability, and the keycap may be restored in an upward manner through a top support of the elastic protruding portion after being pressed down. Accordingly, unlike the conventional design which requires the configuration of a scissor mechanism under the keycap, the disclosure may effectively reduce the overall thickness of the key structure. Moreover, since the elastic protruding portion is formed under the central region of the keycap, the trigger position (i.e., the electrical trigger point) of signals is not disposed under the central region of the keycap but disposed under the peripheral region of the keycap, and the elastic protruding portion is prevented from being overlapped with the trigger position of signals, which contributes to eliminating the configuration difficulty.

What is claimed is:

1. A key structure, comprising:

a bottom plate comprising at least one elastic protruding portion;

at least one keycap liftably connected to the bottom plate and comprising a press portion and at least one trigger portion, wherein the press portion is located in a central region of the at least one keycap and faces the at least one elastic protruding portion, and the at least one trigger portion is located in a peripheral region of the at least one keycap, wherein when the at least one keycap is lowered from a first position to a second position relative to the bottom plate, the press portion downwardly presses the at least one elastic protruding portion, and the at least one keycap is adapted to restore from the second position to the first position through an elastic force of the at least one elastic protruding portion; and a thin-film circuit board disposed on the bottom plate and located between the bottom plate and the at least one keycap, wherein the thin-film circuit board comprises at least one electrical trigger point, and the at least one trigger portion faces the at least one electrical trigger point, wherein when the at least one keycap is located at the second position, the at least one trigger portion triggers the at least one electrical trigger point.

2. The key structure according to claim 1, wherein the bottom plate comprises a plurality of holes, and a portion of the bottom plate among the holes constitutes the at least one elastic protruding portion.

3. The key structure according to claim 1, wherein the at least one elastic protruding portion comprises a protruding point, and the protruding point is in contact with the press portion.

4. The key structure according to claim 1, wherein the bottom plate comprises at least one first sliding portion, the at least one keycap comprises at least one second sliding portion, and the at least one first sliding portion and the at least one second sliding portion are slidably disposed on each other, wherein when the at least one keycap is lifted and lowered relative to the bottom plate, the at least one first sliding portion and the at least one second sliding portion slide relatively to each other.

5. The key structure according to claim 4, wherein the at least one second sliding portion comprises a sliding groove, and an end of the at least one first sliding portion is confined in the sliding groove, wherein when the at least one keycap is lifted and lowered relative to the bottom plate, the end slides in the sliding groove.

6. The key structure according to claim 5, wherein the at least one sliding groove comprises an opening facing the bottom plate, and an outer diameter of the end is greater than an inner diameter of the opening.

7. The key structure according to claim 4, wherein the at least one first sliding portion comprises a slot, the at least one second sliding portion comprises a hook, and the hook is clamped in the slot, wherein when the at least one keycap is lifted and lowered relative to the bottom plate, the hook moves in the slot.

8. The key structure according to claim 4, wherein the at least one first sliding portion is formed by bending part of a structure of the bottom plate.

9. The key structure according to claim 4, wherein the thin-film circuit board comprises an opening, and the at least one first sliding portion passes through the opening and extends toward the at least one keycap.

10. The key structure according to claim 1, wherein the thin-film circuit board comprises an opening, and the at least one elastic protruding portion passes through the opening and protrudes toward the at least one keycap.

11. The key structure according to claim 1, wherein the at least one keycap comprises an annular flange extending along a periphery of the at least one keycap, and the at least one trigger portion is at least one convex point formed on the annular flange.

12. The key structure according to claim 1, wherein a number of the at least one trigger portion is plural, and the trigger portions are located at a plurality of corners of the at least one keycap, respectively.

* * * * *